US010480512B2

(12) United States Patent
Seghers et al.

(10) Patent No.: US 10,480,512 B2
(45) Date of Patent: Nov. 19, 2019

(54) METHOD FOR CONTROLLING AN OIL-INJECTED COMPRESSOR DEVICE

(71) Applicant: ATLAS COPCO AIRPOWER, NAAMLOZE VENNOOTSCHAP, Wilrijk (BE)

(72) Inventors: Andreas Mathias Jonas Seghers, Wilrijk (BE); Wim Moens, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 260 days.

(21) Appl. No.: 15/511,760

(22) PCT Filed: Sep. 21, 2015

(86) PCT No.: PCT/BE2015/000046
§ 371 (c)(1),
(2) Date: Mar. 16, 2017

(87) PCT Pub. No.: WO2016/041026
PCT Pub. Date: Mar. 24, 2016

(65) Prior Publication Data

US 2017/0298937 A1 Oct. 19, 2017

(30) Foreign Application Priority Data

Sep. 19, 2014 (BE) ..... 2014/0711

(51) Int. Cl.
*F03C 2/00* (2006.01)
*F03C 4/00* (2006.01)
(Continued)

(52) U.S. Cl.
CPC ..... *F04C 29/021* (2013.01); *F04C 18/16* (2013.01); *F04C 28/08* (2013.01); *F04C 28/24* (2013.01);
(Continued)

(58) Field of Classification Search
CPC .. F04C 29/0014; F04C 29/021; F04C 29/026; F04C 29/042; F04C 18/16; F04C 28/24;
(Continued)

(56) References Cited

U.S. PATENT DOCUMENTS 4,123,203 A * 10/1978 Kathmann ..... F04C 29/0014 418/84
RE30,499 E * 2/1981 Moody, Jr. ..... F25B 31/008 62/117
(Continued)

FOREIGN PATENT DOCUMENTS

| | | |
|---|---|---|
| GB | 2 394 025 A | 4/2004 |
| JP | 6213188 A | 8/1994 |
| WO | 2007/045052 A1 | 4/2007 |

OTHER PUBLICATIONS

JPH06213188A—Tsuboi Noboru, Oil-Cooled Compressor—Aug. 2, 1994—English Translation (Year: 1994).*
(Continued)

*Primary Examiner* — Theresa Trieu
(74) *Attorney, Agent, or Firm* — Sughrue Mion, PLLC

(57) ABSTRACT

A method for controlling a compressor device (1) with a compressor element (2) and oil circuit (14) with oil (15) that is injected into the compressor element (2) by a fan (19) via a cooler (18), with a bypass pipe (20) across the cooler (18), whereby when the temperature (T) of the compressor element (2) is less than a value ($T_{set}$), the method including the following steps: switching the fan (19) off; when the temperature (T) is still less than $T_{set}$, driving the oil (15) via the
(Continued)

bypass pipe (20); when the temperature (T) is still less than $T_{set}$, decreasing the quantity of oil (15) that is injected into the compressor element (2) until the temperature (T) is equal to $T_{set}$.

21 Claims, 3 Drawing Sheets

(51) Int. Cl.

| | |
|---|---|
| ***F04C 2/00*** | (2006.01) |
| ***F04C 29/02*** | (2006.01) |
| ***F04C 29/00*** | (2006.01) |
| ***F04C 29/04*** | (2006.01) |
| ***F04C 18/16*** | (2006.01) |
| ***F04C 28/08*** | (2006.01) |
| ***F04C 28/24*** | (2006.01) |

(52) U.S. Cl.
CPC ..... *F04C 29/0014* (2013.01); *F04C 29/026* (2013.01); *F04C 29/042* (2013.01); *F04C 2270/185* (2013.01); *F04C 2270/195* (2013.01)

(58) Field of Classification Search
CPC ..... F04C 28/08; F04C 2270/185; F04C 2270/195
USPC ..... 418/1, 83, 201.1, 270, DIG. 1
See application file for complete search history.

(56) References Cited

U.S. PATENT DOCUMENTS

| | | | | |
|---|---|---|---|---|
| 5,318,151 | A | 6/1994 | Hood et al. | |
| 5,653,585 | A * | 8/1997 | Fresco | F04C 29/026 418/85 |
| 7,413,419 | B2 * | 8/2008 | De Smedt | F04C 29/02 417/410.4 |
| 8,226,378 | B2 * | 7/2012 | Daniels | F04B 39/0207 417/228 |
| 2005/0089432 | A1 | 4/2005 | Truyens et al. | |
| 2009/0252632 | A1 * | 10/2009 | Daniels | F04C 29/0014 418/84 |

OTHER PUBLICATIONS

Communication dated Aug. 9, 2018, from New Zealand Intellectual Property Office in counterpart application No. 730649.
International Search Report of PCT/BE2015/000046, dated Mar. 2, 2016 (PCT/ISA/237).
Communication dated Jul. 30, 2018 from the State Intellectual Property Department of the P.R.C. in counterpart application No. 201580050147.4.
Communication dated Jul. 2, 2018 issued by the Australian Intellectual Property Office in counterpart Australian Patent Application No. 2015318763.

* cited by examiner

METHOD FOR CONTROLLING AN OIL-INJECTED COMPRESSOR DEVICE

CROSS REFERENCE TO RELATED APPLICATIONS

This application is a National Stage of International Application No. PCT/BE2015/000046 filed Sep. 21, 2015, claiming priority based on Belgian Patent Application No. 2014/0711, filed Sep. 19, 2014, the contents of all of which are incorporated herein by reference in their entirety.

BACKGROUND OF THE INVENTION

Field of the Invention

The present invention relates to a method for controlling an oil-injected compressor device.

Background

More specifically the invention is intended for an oil-injected compressor device with at least one compressor element with an inlet for gas to be compressed and an outlet for compressed gas whereby the compressor device is provided with an oil circuit with an oil separator with an input that is connected to the outlet of the compressor element and an output to which a consumer compressed gas network can be connected, whereby this oil separator comprises a pressure vessel in which the oil separated from the compressed gas is received and from which oil can be guided to a cooler and can then be injected into the compressor element, whereby this cooler is cooled by a coolant that is guided through the cooler by means of a fan or pump.

It is known that to change the flow rate that such a compressor installation supplies, the speed of the compressor element can be changed by means of the variable speed controller.

By reducing the speed of the compressor element, the flow delivered will also fall.

The speed of the compressor element cannot fall without limit, but is limited to a specific lower limit.

This means that the flow rate cannot fall without limit either.

If the flow must be further reduced, it could be chosen to apply an inlet throttle valve.

The use of such an inlet throttle valve is known in compressor installations where the compressor element is driven at a constant speed.

In order to throttle the inlet, use is made of a butterfly valve for example that is affixed in the inlet pipe.

This will ensure that the inlet pipe is partly closed off so that the gas flow supplied and thus also the flow rate delivered is reduced.

The application of an inlet throttle valve in a compressor installation with a compressor element with a variable speed controller has turned out not to be possible in the past or is impractical to implement.

Due to the reduced flow rate supplied as a result of the throttling, less power will be absorbed by the compressor element.

As a result less heat will be generated, which can lead to problems when the temperature of the compressor installation becomes too low.

After all it is necessary to keep the temperature within certain limits, as at too low a temperature condensation can occur, which can lead to problems throughout the entire machine, and at too high a temperature the oil used for cooling and lubrication will deteriorate more quickly.

Methods are already known that are provided to ensure that the temperature of the oil of an oil-injected compressor device with a constant speed does not become too low in order to prevent condensation in the oil.

Such a known method is described in WO 2007/045052 by the same applicant, whereby a bypass pipe is provided across the oil cooler and a thermostatic controller that ensures that when the temperature of the oil threatens to become too low, at least a proportion of the oil to be injected is not driven entirely or partially through the cooler but is driven directly to the compressor element without cooling.

In this case, the compressor element and the fan that is used to cool the oil in the cooler both continue at a constant speed driven by a thermal engine, even when no cooling is required if the oil is entirely or partially diverted through the bypass pipe, which brings about an energy loss.

In this known way, the control to prevent condensation is limited to the distribution of the quantity of oil that is guided through the cooler and the quantity of oil that is injected directly into the compressor element without cooling.

Another method is known from GB 2.394.025 whereby a thermostatic valve ensures that the temperature of the injected oil does not fall below a set value and whereby in addition a thermostatically controlled control valve is applied that controls the quantity of injected oil as a function of the temperature of the injected oil. Both controls are done simultaneously and independently from one another and other controls.

SUMMARY OF THE INVENTION

The purpose of the present invention is to provide a solution to at least one of the aforementioned and other disadvantages.

The subject of the present invention is a method for controlling an oil-injected compressor device with at least one compressor element with an inlet for gas to be compressed and an outlet for compressed gas and with a variable speed controller, whereby the compressor device is provided with an oil circuit with an oil separator with an input that is connected to the outlet of the compressor element and an output to which a compressed gas consumer network can be connected, whereby this oil separator comprises a pressure vessel in which the oil separated from the compressed gas is received and from which oil can be guided to a cooler and can then be injected into the compressor element, whereby this cooler is cooled by a coolant that is guided through the cooler by means of a fan or pump, with the characteristic that a bypass pipe for oil is provided across the cooler, whereby the method consists of determining the temperature at the outlet of the compressor element and when this determined temperature is less than a preset value, the following steps are taken successively:

- first the fan or pump is switched off or its speed is decreased for as long as the temperature at the outlet is less than the preset value and the minimum speed of the fan or pump is not reached;
- then the temperature at the outlet of the compressor element is determined again and, when this temperature at the outlet is still less than the preset value, the oil is driven through the bypass pipe to the compressor element or an increasing proportion of the oil is driven through the bypass pipe to the compressor element as long as the maximum quantity of oil has not been reached;

then, when the maximum quantity of oil that is driven through the bypass pipe to the compressor element is reached, the temperature at the outlet of the compressor element is determined again, and when this temperature at the outlet is less than the preset value, the quantity of oil that is injected into the compressor element is reduced until the temperature at the outlet is at least equal to the preset value or the minimum quantity of oil is reached.

An advantage is that such a method will prevent the temperature of the compressor device becoming too low because the method will bring about a gradual reduction of the cooling capacity of the oil circuit, by implementing the various successive controls step by step.

In this way the formation of condensate can be prevented, for example.

Such a method is very useful for application in a compressor element that comprises a controllable inlet throttle valve.

When such a compressor element rotates at a reduced or minimum speed, whereby the inlet throttle valve throttles the inlet so that less power is absorbed by the compressor element, the application of such a method will ensure that the temperature does not become too low.

In this way the minimum flow rate that a speed controlled compressor device can deliver can be made lower through the application of an inlet throttle valve without the risk of condensate formation and all detrimental consequences thereof.

An additional advantage is that the fan or the pump is first switched off or adjusted when the cooling capacity must be reduced, such that less energy is consumed.

Another advantage is that only in a last step is the oil supply reduced, so that the lubrication of the compressor element by the oil is not jeopardised.

Analogously the method according to the invention provides a control of the temperature at the outlet to ensure that this temperature does not become higher than a set value, whereby the following steps are taken successively:

first the quantity of oil that is injected into the compressor element is increased for as long as the set value of the temperature and the maximum quantity of injected oil have not been reached;

then, when the maximum quantity of oil that is injected into the compressor element has been reached, the temperature at the outlet is determined again and, when this temperature is still higher than the set value, the oil is driven through the cooler to the compressor element;

then the temperature at the outlet of the compressor element is determined again and, when this temperature at the outlet is still higher than the set value, the fan or pump is switched on or its speed is increased.

BRIEF DESCRIPTION OF THE DRAWINGS

With the intention of better showing the characteristics of the invention, a few preferred applications of the method according to the invention for controlling an oil-injected compressor device are described hereinafter by way of an example, without any limiting nature, with reference to the accompanying drawings, wherein.

DETAILED DESCRIPTION OF THE INVENTION

Figure 1:
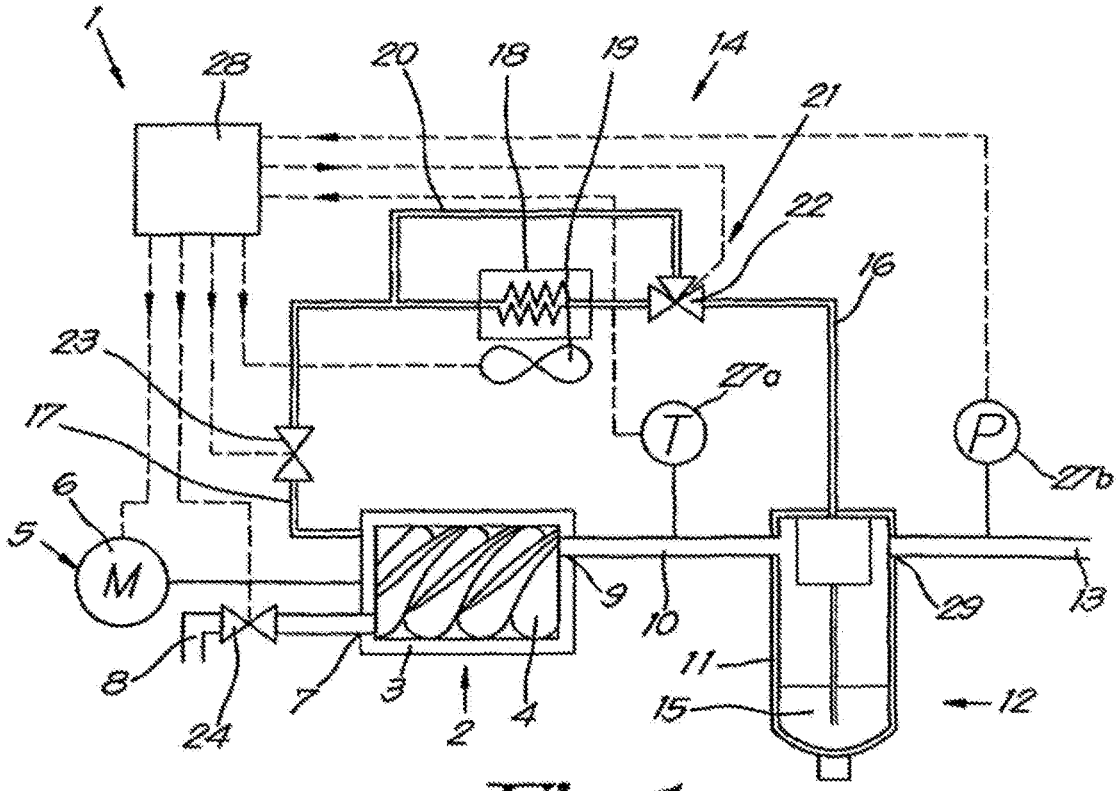
FIG. 1 schematically shows an oil-injected compressor device for application in a method according to the invention.
Figure 2:
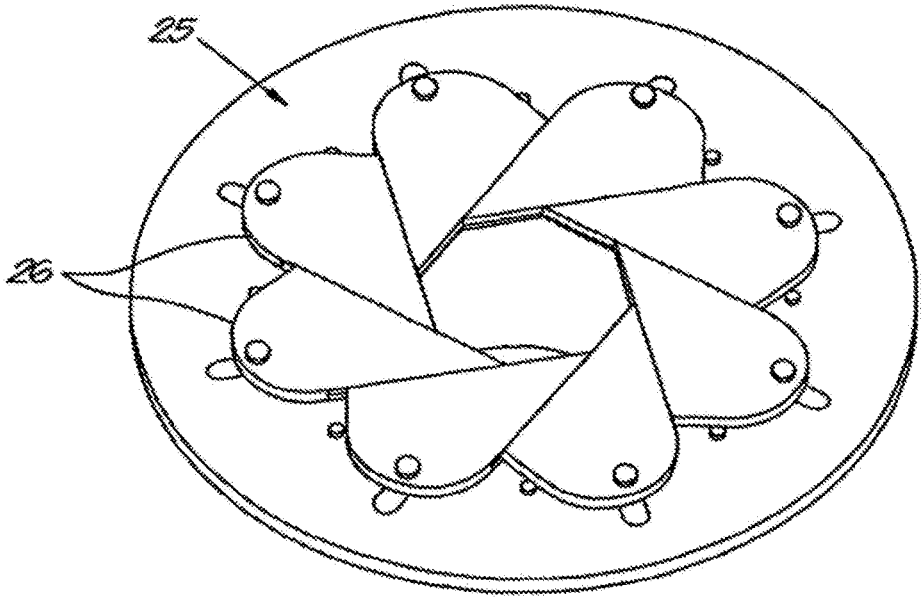
FIG. 2 schematically shows a possible embodiment of the inlet throttle valve.
Figure 3:
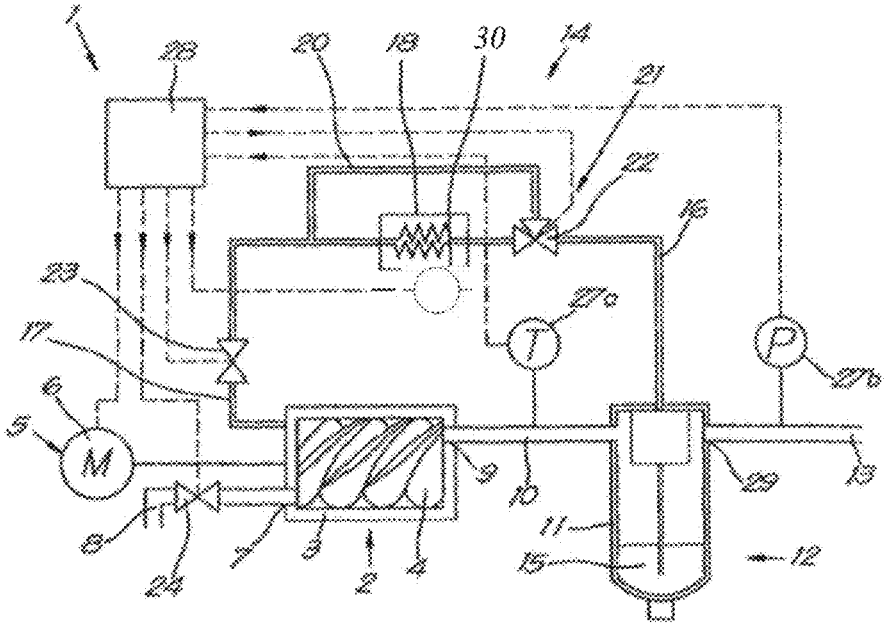
FIG. 3 schematically shows an oil-injected compressor device for application in a method according an embodiment.

The oil-injected compressor device 1 shown in FIG. 1 and FIG. 2 essentially comprises a compressor element 2, in this case of the known screw type with a housing 3 in which two enmeshed helical rotors 4 are driven by means of a variable speed controller 5.

It is clear that the compressor element 2 can also be of a different type, such as a turbocompressor element, without departing from the scope of the invention.

In this case this variable speed controller 5 is a motor 6 whose speed is variable.

The housing 3 is provided with an inlet 7 that is connected to an inlet pipe 8 for the supply of gas to be compressed, such as air or another gas or mixture of gases.

The housing 3 is provided with an outlet 9 that is connected to an outlet pipe 10.

The outlet pipe 10 is connected, via a pressure vessel 11 of an oil separator 12 and a pressure pipe 13 connected thereto, to a downstream consumer network for the supply of various pneumatic tools or similar that are not shown here.

The compressor installation 1 is provided with an oil circuit 14 to inject oil 15 from the pressure vessel 11, via a feed pipe 16 and injection pipe 17, into the compressor element 2 for the cooling and if applicable the lubrication and/or seal between the rotors 4 mutually and the rotors 4 and the housing 3.

The oil 15 that is injected can hereby pass through a cooler 18 to cool the oil 15 from the pressure vessel 11.

In this case the cooler 18 is provided with a fan 19 to ensure the cooling, although it is not excluded that instead of using cooling air for the cooling, a liquid coolant is used that is guided through the cooler by means of a pump 30. In this case, but not necessarily, the fan 19 is a controllable fan, i.e. the speed of the fan 19 can be controlled.

According to the invention the oil 15 can also be guided to the compressor element 2 through a bypass pipe 20, whereby in this case the oil 15 does not pass via the cooler 18.

In this case a three-way valve 22 is provided at the branch 21 of the bypass pipe 20, upstream from the cooler 18, in order to control the quantity of oil 15 that can flow through the bypass pipe 20 and through the cooler 18.

It is clear that this can also be controlled in a different way than with a three-way valve 22.

Furthermore means are provided to be able to adjust the quantity of oil 15 that is injected into the compressor element 2, for example in the form of an injection valve 23 in the injection pipe 17, or by a suitable choice of diameter of injection pipe from a series of available diameters.

In this example an inlet throttle valve 24 is provided in the inlet pipe 8.

In this case use is made of an inlet valve for the inlet throttle valve 24 that comprises a housing that contains an aperture 25 in the form of a number of strips 26 that are movably affixed in the housing, whereby the strips 26 are movable between a closed position whereby strips 26 close off the inlet pipe 8 and an open position whereby the strips 26 are turned away from the inlet pipe 8. A possible embodiment of such an inlet valve with an aperture 25 is shown in FIG. 2. It is clear that such an inlet valve can be constructed in many different ways.

An advantage of such an inlet valve is that the strips 26 can be completely turned away from the inlet pipe 8, and thus the inlet 7, such that in the open state the aperture 25 does not form an impediment for the supply of air to be compressed.

This is in contrast to a butterfly valve for example, which even in a fully open state will partially block the passage of the inlet pipe 8.

The oil-injected compressor device 1 is also provided with means 27*a* to determine the temperature T at the outlet 9 of the compressor element 2 and with means 27*b* to determine the pressure p in the pressure pipe 13. These means 27*a* and 27*b* respectively can be a temperature sensor or a pressure sensor for example.

Furthermore, in this case a controller 28 is also provided that ensures the control of the motor 6, the fan 19, the three-way valve 22, the injection valve 23 in the injection pipe 17 and the inlet throttle valve 24. The controller 28 is also connected to the temperature sensor and the pressure sensor.

The operation of the compressor device 1 and the method according to the invention for the control thereof is very simple and as follows.

During the operation of the compressor device 1 the compressor element 2 will compress gas that is supplied via the inlet pipe 8.

In order to guarantee the good operation of the compressor element 2, oil 15 will be injected into the compressor element 2. This oil 15 is injected into the compressor element 2 via the feed pipe 16 and the injection pipe 17 under the influence of the pressure in the pressure vessel 12.

The compressed gas is guided to the pressure vessel 11 from the oil separator 12 via the outlet pipe 10.

The oil 15 that is present in the compressed gas is separated in the oil separator 12 and received in the pressure vessel 11.

The compressed gas that is now free of oil 15 is brought to a consumer network via the pressure pipe 13.

In order to ensure that the demand for compressed gas by the consumer network is satisfied, the pressure p downstream from the outlet 29 of the oil separator 12 is determined by the pressure sensor.

The signal from the pressure sensor is read by the controller 28.

The controller 28 will control the compressor device 1, more specifically the motor 6 and the inlet throttle valve 24, such that the required flow rate is delivered by the compressor element 2 to maintain the pressure p downstream from the outlet 29 of the oil separator 12 at a desired value $p_{set}$.

In this case this is done according to the following control of the motor 6 and the inlet throttle valve 24.

When the pressure p is less than the desired value $p_{set}$, in other words when the consumption of compressed gas is greater than the flow rate delivered by the compressor device 1, the controller 28 will ensure that the delivered flow rate becomes greater by gradually opening the inlet throttle valve 24 in the first instance, if it is throttling the inlet 9 at that time, until the pressure p is again equal to the desired value $p_{set}$.

When the pressure p is still less than the desired value $p_{set}$, when the inlet throttle valve 24 is fully open, the controller 28 will gradually increase the speed of the compressor element 2 so that the flow rate delivered by the compressor element will rise until the pressure p downstream from the outlet 29 of the oil separator 21 is equal to the desired value $p_{set}$.

This means that at this time the demand for compressed gas is equal to the flow rate delivered.

When the pressure p is greater than a desired value $p_{set}$, in other words when the consumption of compressed gas is less than the flow rate delivered by the compressor device 1, the controller 28 will ensure that the delivered flow rate becomes smaller by gradually reducing the speed of the compressor element 2 in the first instance so that the flow rate delivered by the compressor element 2 will fall until the pressure p is again equal to the desired value $p_{set}$.

When the pressure p is still higher than the desired value $p_{set}$ when the minimum speed has been reached, the controller 28 will gradually close the inlet throttle valve 24 until the pressure p downstream from the outlet 29 of the oil separator 12 is equal to the desired value $p_{set}$.

The inlet throttle valve 24 will be closed to a minimum opening. When the pressure p is still too high, the controller 28 will stop the compressor element. The inlet throttle valve 24 will then also fully close to prevent an air and oil flow in the opposite direction.

When the compressor device 1 is started up again, the compressor element 2 will operate at a minimum speed and the inlet throttle valve 24 will be open to a minimum.

The controller 28 will then gradually open the inlet throttle valve 24 in order to limit the starting torque for the motor 6. Only if the inlet throttle valve 24 has been fully opened will the speed of the compressor element be increased.

An advantage of such a control of the pressure p at the outlet 29 is that it will lead to the inlet throttle valve 24 being kept open as much as possible. After all, when the flow rate must be reduced, the speed of the compressor element 2 will first be reduced before adjusting the inlet throttle valve 24, and when the flow rate must be increased the inlet throttle valve 24 will first be opened if it is still not fully open.

Due to the use of the inlet throttle valve 24 in combination with the variable speed control, it is possible for the temperature T at the outlet 9 of the compressor element 2 to fall when the compressor element 2 is driven at a minimum speed and the inlet 7 is throttled.

As long as there is a high demand for compressed gas, the inlet throttle valve 24 will be fully open and the compressor element 2 will operate at its maximum speed. In this case the controller 28 will control the oil circuit 14 such that the cooling capacity is a maximum, i.e.:

- the injection valve 23 is fully open so that the entire oil flow is injected;
- all oil 15 will flow through the cooler 18;
- the fan 19 will operate at a maximum speed.

However, if the demanded flow rate falls sharply, the speed of the compressor element 2 will fall to the minimum speed and additionally the inlet throttle valve 24 will throttle the inlet 7 of the compressor element 2 to attune the delivered flow rate to the demanded flow rate.

As a result the power absorbed by the compressor element 2 will fall and consequently also the temperature T.

In order to resolve the problems that are coupled to this temperature drop, such as condensate formation for example, the controller 28 according to the invention will control the compressor installation 1 according to the following control:

When the temperature T falls below a preset value $T_{set}$, in the first instance the speed of the van 19 is gradually reduced. If this is not sufficient because the temperature T, after stabilisation or after expiry of a set time, remains too low, the fan 19 will finally be switched off.

If an 'on/off' fan 19 is used, the fan is switched off immediately.

The aforementioned preset value $T_{set}$ is of course preferably at least equal to the condensation temperature $T_c$, preferably increased by a certain value, whereby $T_c$ can have a fixed value or can be a value that is calculated on the basis of the measured ambient temperature, relative humidity and operating pressure or which can be estimated subject to a few assumptions.

This will ensure extra safety to prevent condensation. This specific value can be at least 1° C. or at least 5° C. or at least 10° C., or in extremis also 0° C. if it is to be operated at the safety limit.

This will depend on the level of extra safety that is desired to prevent the formation of condensate in the compressor device 1.

Then, when the temperature T at the outlet 9, after stabilisation or after expiry of a set time, is still below the preset value $T_{set}$, the controller 28 will control the three-way valve 22 such that at least a proportion of the oil flow is driven through the bypass pipe 20 instead of through the cooler 18. The oil 15 that flows through the bypass pipe 20 will not be cooled so that the cooling capacity of the oil circuit 14 will decrease.

If necessary, the controller 28 will ensure that an increasing proportion of the oil flow will be driven through the bypass pipe 20, in order to let the cooling capacity decrease and the temperature T increase to above the preset value $T_{set}$.

When all the oil is driven through the bypass pipe 20 and the temperature T, after stabilisation or after expiry of a set time, is still too low, the controller 28 will let the cooling capacity decrease by controlling the injection valve 23 in the injection pipe 17, so that the quantity of oil 15 that is injected is reduced.

The quantity of oil 15 will be reduced until the temperature T is at least equal to the preset value $T_{set}$, so that condensate formation is prevented.

Using the controllable fan 19, or if applicable using a controllable pump 30, and the oil circuit 14 whereby the oil 15 can be driven through the bypass pipe 20 and partially through the cooler 18, the cooling capacity can be continuously controlled, without the quantity of oil 15 that is injected having to be changed for this purpose.

Moreover, only in the last instance is the quantity of injected oil 15 reduced, so that the lubrication and seal between the rotors 4 and/or the rotors 4 and the housing 3 by the oil 15 does not decrease.

It is clear that the method described above is not only applicable when the inlet throttle valve 24 throttles the inlet 7 of the compressor element 2, but also at any other time when the temperature T is lower than the preset value $T_{set}$, even if the inlet throttle valve 24 does not throttle the inlet 7 or even if there is no throttle valve in the case of a variable controlled compressor device.

An analogous control can also be used to ensure that the temperature T at the outlet 9 does not become higher than a set value $T_{max}$. This control can be used alone or in combination with the control of the temperature described above relating to $T_{set}$.

This set value Tmax is limited by an ISO standard and its maximum is equal to the degradation temperature $T_d$ of the oil 15 for example. If applicable the set value $T_{max}$ can be a few degrees less than this degradation temperature $T_d$ to build in a certain safety, for example 1° C., 5° C. or 10° C., depending on the level of extra safety that is desired or required.

To this end the controller 28 will determine the temperature T at the outlet 9 and if it is higher than the set value $T_{max}$, the controller 28 will control the injection valve 23 to increase the quantity of oil 15 that is injected until the temperature T at the outlet 9 falls to the set value $T_{max}$.

If the maximum quantity of oil 15 is already being injected or if the temperature T at the outlet 9, after stabilisation or after expiry of a set time, is still too high when the maximum quantity of oil 15 is being injected, the controller 28 will take a subsequent step to increase the cooling capacity.

This next step involves controlling the three-way valve 22 so that at least a proportion of the oil flow is driven through the cooler 18.

If this was already the case or if it is insufficient, the controller 28 will gradually drive a greater proportion of the oil flow through the cooler 18 until the temperature T falls sufficiently.

When it turns out to be necessary to drive the entire oil flow through the cooler 18 and the cooling capacity is still insufficient to make the temperature T fall to the set value $T_{max}$, after stabilisation or after expiry of a set time, the following control by the controller 28 will come into effect.

The controller 28 will switch on the fan 19 or pump 30 if applicable, whereby the speed is increased.

As a result the oil 15 in the cooler 18 will be cooled more.

The speed of the fan 19 is increased until the temperature T at the outlet 9 is, at a maximum, equal to the set value $T_{max}$.

Due to a combination of both methods to control the temperature T, it can be ensured that the temperature T is kept within certain limits in order to increase the lifetime of the oil 15 and the compressor installation 1.

Moreover such a method will ensure that the fan 19 or pump 30 is always the first to be switched off or the last to be switched on when the cooling capacity of the oil circuit 14 has to be decreased or increased, which will ensure an energy saving.

Figure 4:
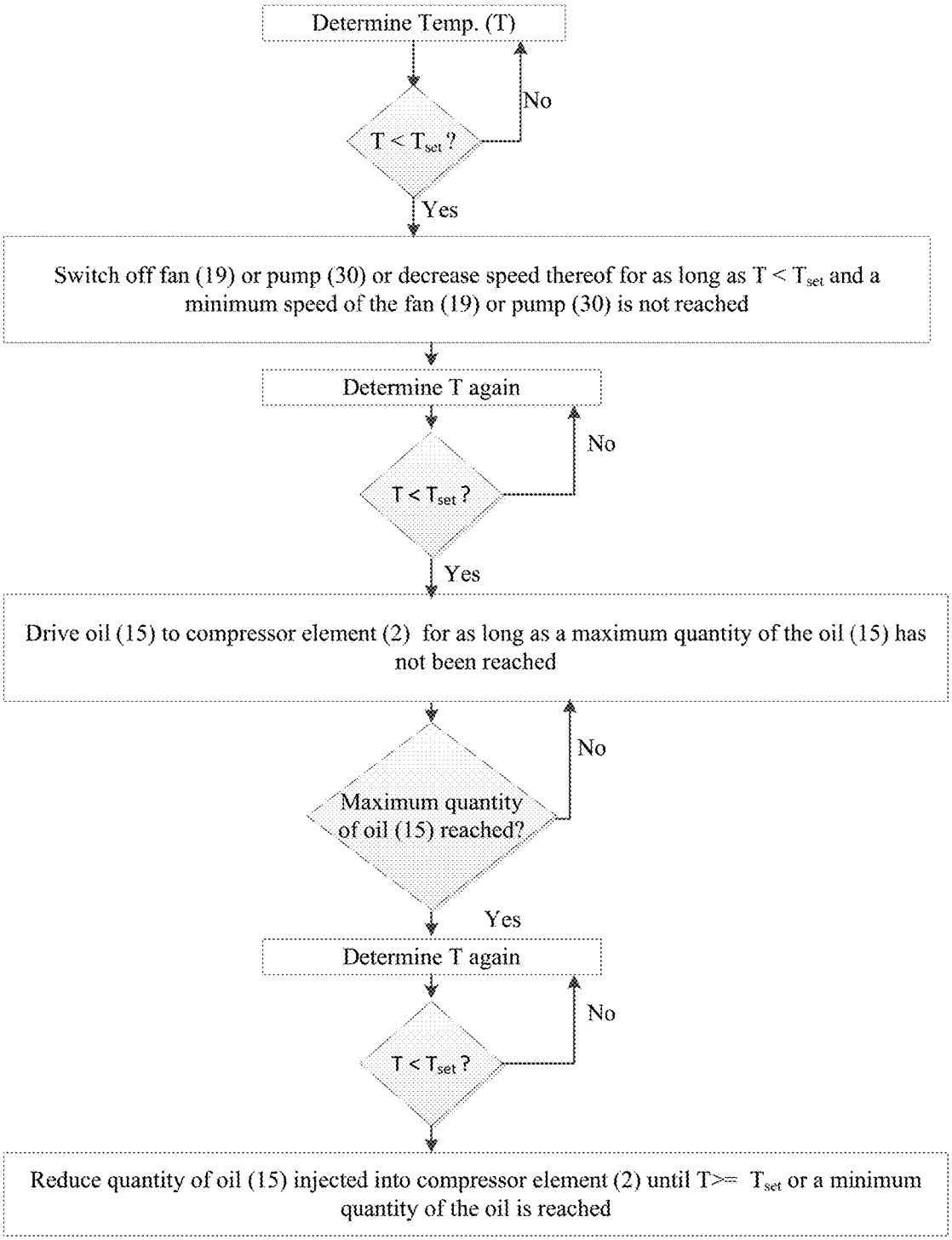
FIG. 4 is a flow chart of a method according to an embodiment.

FIG. 4 is a flowchart of an example method for controlling an oil-injected compressor device (1) with at least one compressor element (2) with an inlet (7) for gas to be compressed and an outlet (9) for compressed gas and with a variable speed controller (5), whereby the compressor device (1) is provided with an oil circuit (14) with an oil separator (12) with an input that is connected to the outlet (9) of the compressor element (2) and an output to which a compressed gas consumer network is connected, whereby this oil separator (12) comprises a pressure vessel (11) in which oil (15) separated from the compressed gas is received and from which the oil (15) is guided to a cooler (18) and is then injected into the compressor element (2), whereby this cooler (18) is cooled by a coolant that is guided through the cooler by means of a fan (19) or pump (30), wherein a bypass pipe (20) for the oil (15) is provided across the cooler (18), according to an embodiment.

As illustrated in FIG. 4, the method may comprise determining a temperature (T) at the outlet (9) of the compressor element (2) (S100). When this determined temperature (T) at the outlet (9) is less than a preset value (Tset) (S101), the following steps are taken successively: first the fan (19) or pump (30) is switched off or its speed is decreased for as long as the temperature (T) at the outlet (9) is less than the preset value (Tset) and a minimum speed of the fan (19) or pump (30) is not reached (S102); then the temperature (T) at the outlet (9) of the compressor element (2) is determined again (S103) and, when this temperature (T) at the outlet (9) is still less than the preset value (Tset) (S104), the oil (15) is driven through the bypass pipe (20) to the compressor element (2) or an increasing proportion of the oil (15) is driven through the bypass pipe (20) to the compressor element (2) for as long as a maximum quantity of the oil (15) has not been reached (S105); then, when the maximum quantity of the oil that is driven through the bypass pipe (20) to the compressor element (2) is reached (S106), the temperature (T) at the outlet (9) of the compressor element (2) is determined again (S107), and when this temperature (T) at the outlet (9) is less than the preset value (Tset) (S108), the quantity of oil (15) that is injected into the compressor element (2) is reduced until the temperature (T) at the outlet (9) is at least equal to the preset value (Tset) or a minimum quantity of the oil is reached (S109).

The present invention is by no means limited to the embodiments described as an example and shown in the drawings, but such a method according to the invention for controlling an oil-injected compressor device can be realised according to different variants without departing from the scope of the invention.

The invention claimed is:

1. A method for controlling an oil-injected compressor device (1) with at least one compressor element (2) with an inlet (7) for gas to be compressed and an outlet (9) for compressed gas and with a variable speed controller (5), whereby the compressor device (1) is provided with an oil circuit (14) with an oil separator (12) with an input that is connected to the outlet (9) of the compressor element (2) and an output to which a compressed gas consumer network is connected, whereby this oil separator (12) comprises a pressure vessel (11) in which oil (15) separated from the compressed gas is received and from which the oil (15) is guided to a cooler (18) and is then injected into the compressor element (2), whereby this cooler (18) is cooled by a coolant that is guided through the cooler by means of a fan (19) or pump (30), wherein a bypass pipe (20) for the oil (15) is provided across the cooler (18), wherein the method comprises determining a temperature (T) at the outlet (9) of the compressor element and when this determined temperature (T) at the outlet (9) is less than a preset value ($T_{set}$), the following steps are taken successively:

first the fan (19) or pump (30) is switched off or its speed is decreased for as long as the temperature (T) at the outlet (9) is less than the preset value ($T_{set}$) and a minimum speed of the fan (19) or pump (30) is not reached;

then the temperature (T) at the outlet (9) of the compressor element (2) is determined again and, when this temperature (T) at the outlet (9) is still less than the preset value ($T_{set}$), the oil (15) is driven through the bypass pipe (20) to the compressor element (2) or an increasing proportion of the oil (15) is driven through the bypass pipe (20) to the compressor element (2) for as long as a maximum quantity of the oil (15) has not been reached;

then, when the maximum quantity of the oil that is driven through the bypass pipe (20) to the compressor element (2) is reached, the temperature (T) at the outlet (9) of the compressor element (2) is determined again, and when this temperature (T) at the outlet (9) is less than the preset value ($T_{set}$), the quantity of oil (15) that is injected into the compressor element (2) is reduced until the temperature (T) at the outlet (9) is at least equal to the preset value ($T_{set}$) or a minimum quantity of the oil is reached.

2. The method according to claim 1, wherein after each of the aforementioned successive steps a subsequent step is only implemented after the temperature (T) at the outlet (9) of the compressor element (2) has stabilised or after expiry of a set period of time.

3. The method according to claim 1, wherein the compressor element (2) comprises a controllable inlet throttle valve (24) and that at least when the inlet throttle valve (24) throttles the inlet (7) of the compressor element (2), the aforementioned steps are implemented.

4. The method according to claim 3, wherein the method comprises the step of determining the pressure (p) downstream from the outlet of the oil separator (12), whereby one of the following steps is taken:

when the pressure (p) downstream from the outlet of the oil separator (12) is higher than a desired value ($p_{set}$), the speed of the compressor element (2) is gradually decreased and if applicable the inlet throttle valve (24) is also gradually closed until the aforementioned pressure (p) is equal to a set value ($p_{set}$);

when the pressure (p) downstream from the outlet of the oil separator (12) is less than the desired value ($p_{set}$), the inlet throttle valve (24) is gradually opened and if applicable the speed of the compressor element (2) is increased until the aforementioned pressure (p) is equal to the set value ($p_{set}$).

5. The method according to claim 3, wherein for the inlet throttle valve (24) use is made of an inlet valve that comprises a housing that contains an aperture (25) in the form of a number of strips (26) that are movably affixed in the housing, whereby the strips (26) are movable between a closed position whereby the strips (26) close off the inlet (7) of the compressor element (2) and an open position whereby the strips (26) are turned away from the inlet (7).

6. The method according to claim 1, wherein when the temperature (T) at the outlet (9) is higher than a set value ($T_{max}$), the following successive steps are taken:

first the quantity of the oil (15) that is injected into the compressor element (2) is increased for as long as the set value ($T_{max}$) of the temperature and the maximum quantity of injected oil have not been reached;

then, when the maximum quantity of the oil (15) that is injected into the compressor element (2) has been reached, the temperature (T) at the outlet (9) is determined again and, when this temperature (T) is still higher than the set value ($T_{max}$), the oil (15) is driven through the cooler (18) to the compressor element (2);

then the temperature (T) at the outlet (9) of the compressor element (2) is determined again and, when this temperature (T) at the outlet (9) is still higher than the set value ($T_{max}$), the fan (19) or pump (30) is switched on or its speed is increased.

7. The method according to claim 6, wherein after each of the aforementioned successive steps a subsequent step is only implemented after the temperature (T) at the outlet (9) of the compressor element (2) has stabilised or after expiry of a set period of time.

8. The method according to claim 6, wherein the set value ($T_{max}$) is, at a maximum, equal to a degradation temperature ($T_d$) of the oil (15) or a value that is imposed by an ISO standard.

9. The method according to claim 1, wherein the fan (19) or pump (30) is a controllable fan (19) or pump (30) whose speed is controlled, whereby in the step of the switching off the fan (19) or pump (30), the speed of the fan (19) or pump (30) is gradually decreased, whereby then, when the temperature (T) at the outlet (9) remains below the preset value ($T_{set}$), the fan (19) or pump (30) is switched off.

10. The method according to claim 1, wherein the oil circuit (14) is constructed such that the oil (15) is partly guided through the bypass pipe (20) and partly through the cooler (18) whereby during the step of driving the oil (15) through the bypass pipe (20), the following substeps are taken:

at least a proportion of the oil flow is driven through the bypass pipe (20);

then, when the temperature (T) at the outlet (9) of the compressor element (2) is still less than the preset value ($T_{set}$), a larger proportion of the oil flow is gradually driven through the bypass pipe (20).

11. The method according to claim 1, wherein the preset value ($T_{set}$) is above a condensation temperature ($T_c$) by a certain value.

12. The method according to claim 11, wherein the preset value ($T_{set}$) is at least 0° C.

13. The method according to claim 11, wherein the preset value ($T_{set}$) is at least 1° C.

14. The method according to claim 11, wherein the preset value ($T_{set}$) is at least 5° C.

15. The method according to claim 11, wherein the preset value ($T_{set}$) is at least 10° C.

16. The method according to claim 1, wherein the compressor element (2) is a screw compressor element.

17. The method according to claim 1, wherein the fan (19) or pump (30) is a controllable fan (19) or pump (30) whose speed is controlled, whereby in the step of switching on the fan (19) or pump (30), the speed of the fan (19) or pump (30) is gradually increased until the temperature (T) at the outlet (9) is, at a maximum, equal to the set value ($T_{max}$).

18. The method according to claim 1, wherein the oil circuit (14) is constructed such that the oil (15) is partly guided through the bypass pipe (20) and partly through the cooler (18) whereby during the step of driving the oil (15) to the compressor element (2) via the cooler (18), the following substeps are taken:

at least a proportion of the oil flow is driven through the cooler (18);

then, when the temperature (T) at the outlet (9) of the compressor element (2) is still higher than the set value ($T_{max}$), a larger proportion of the oil flow is gradually driven through the cooler (18).

19. A method for controlling an oil-injected compressor device (1) with at least one compressor element (2) with an inlet (7) for gas to be compressed and an outlet (9) for compressed gas and with a variable speed controller (5), whereby the compressor device (1) is provided with an oil circuit (14) with an oil separator (12) with an input that is connected to the outlet (9) of the compressor element (2) and an output to which a compressed gas consumer network is connected, whereby this oil separator (12) comprises a pressure vessel (11) in which oil (15) separated from the compressed gas is received and from which the oil (15) is guided to a cooler (18) and then is injected into the compressor element (2), whereby this cooler (18) is cooled by a coolant that is guided through the cooler by means of a fan (19) or pump (30), wherein a bypass pipe (20) for the oil (15) is provided across the cooler (18), wherein the method comprises determining a temperature (T) at the outlet (9) of the compressor element (2) and when this determined temperature (T) at the outlet (9) is higher than a set value ($T_{max}$), the following successive steps are taken:

first a quantity of oil (15) that is injected into the compressor element (2) is increased for as long as the set value ($T_{max}$) of the temperature and a maximum quantity of injected oil has not been reached;

then, when the maximum quantity of the oil (15) that is injected into the compressor element (2) has been reached, the temperature (T) at the outlet (9) is determined again and, when this temperature (T) is still higher than the set value ($T_{max}$), the oil (15) is driven through the cooler (18) to the compressor element (2);

then, the temperature (T) at the outlet (9) of the compressor element (2) is determined again and, when this temperature (T) at the outlet (9) is still higher than the set value ($T_{max}$), the fan (19) or pump (30) is switched on or its speed is increased.

20. The method according to claim 19, wherein after each of the aforementioned successive steps a subsequent step is only implemented after the temperature (T) at the outlet (9) of the compressor element (2) has stabilised or after expiry of a set period of time.

21. The method according to claim 19, wherein the set value ($T_{max}$) is, at a maximum, equal to a degradation temperature ($T_d$) of the oil (15) or is a value is that is imposed by an ISO standard.

* * * * *